US010672318B2

(12) United States Patent
Lee et al.

(10) Patent No.: US 10,672,318 B2
(45) Date of Patent: Jun. 2, 2020

(54) ORGANIC LIGHT EMITTING DIODE DISPLAY DEVICE AND METHOD OF OPERATING THE SAME IN WHICH RED, GREEN AND BLUE DATA VALUES ARE REDUCED WHEN THERE IS NO WHITE PROPERTY IN A PIXEL

(71) Applicant: LG ELECTRONICS INC., Seoul (KR)

(72) Inventors: Kyungryun Lee, Seoul (KR); Sangjin Ahn, Seoul (KR); Miyeon Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 433 days.

(21) Appl. No.: 15/189,072

(22) Filed: Jun. 22, 2016

(65) Prior Publication Data

US 2017/0270843 A1 Sep. 21, 2017

(30) Foreign Application Priority Data

Mar. 21, 2016 (KR) ..... 10-2016-0033374

(51) Int. Cl.

*G09G 3/20* (2006.01)
*G09G 3/3291* (2016.01)
*G09G 3/3208* (2016.01)

(52) U.S. Cl.

CPC ..... *G09G 3/2003* (2013.01); *G09G 3/3208* (2013.01); *G09G 3/3291* (2013.01); *G09G 2300/0426* (2013.01); *G09G 2300/0452* (2013.01); *G09G 2320/0242* (2013.01); *G09G 2320/0257* (2013.01); *G09G 2320/045* (2013.01); *G09G 2320/046* (2013.01); *G09G 2320/0666* (2013.01); *G09G 2340/06* (2013.01)

(58) Field of Classification Search

CPC ..... G09G 3/2003
See application file for complete search history.

(56) References Cited

U.S. PATENT DOCUMENTS

2010/0013748 A1* 1/2010 Cok ..... H04N 9/67 345/83
2010/0182452 A1* 7/2010 Utsugi ..... H04N 5/217 348/231.2
2013/0265338 A1* 10/2013 Chaji ..... G09G 3/3208 345/690
2014/0085170 A1 3/2014 Park et al.
2014/0118427 A1* 5/2014 Buckley ..... G09G 3/36 345/691
2014/0176623 A1 6/2014 Inoue et al.
2015/0091950 A1 4/2015 Park

FOREIGN PATENT DOCUMENTS

KR 10-2013-0030600 A 3/2013
KR 10-2014-0055030 A 5/2014
KR 10-2014-0116690 A 10/2014

* cited by examiner

*Primary Examiner* — William Boddie
*Assistant Examiner* — Andrew B Schnirel
(74) *Attorney, Agent, or Firm* — Birch Stewart, Kolasch & Birch, LLP

(57) ABSTRACT

Embodiments provide an OLED display device and a method of operating the same, which distribute a load to sub-pixels other than a specific sub-pixel such that the specific sub-pixel is not overloaded by using a WRGB-based OLED pixel structure, preventing a residual image and degradation of the specific sub-pixel, which may occur in the OLED display device.

18 Claims, 11 Drawing Sheets

<MAX White Rendering>

<MIN White Rendering>

RGB OLED : 3sub-pixels

WRGB OLED : 4sub-pixels

ORGANIC LIGHT EMITTING DIODE DISPLAY DEVICE AND METHOD OF OPERATING THE SAME IN WHICH RED, GREEN AND BLUE DATA VALUES ARE REDUCED WHEN THERE IS NO WHITE PROPERTY IN A PIXEL

CROSS-REFERENCE TO RELATED APPLICATIONS

The present application claims the benefit of priority to Korean Patent Application No. 10-2016-0033374, filed on Mar. 21, 2016, which is herein incorporated by reference in its entirety.

BACKGROUND

The present disclosure relates to an organic light emitting diode (hereinafter, referred to as "OLED") display device and a method of operating the same, and more particularly, to an OLED display device and a method of operating the same, which prevent the degradation of the OLED display device.

Recently, various types of display devices have emerged. Of the various types of display devices, an OLED display device has been widely used. Since the OLED display device is a self-illuminating display device, the OLED display device can be manufactured to have lower power consumption and a thinner thickness, compared to a liquid crystal display device in which a back light is necessary. Also, the OLED display device has a wide viewing angle and a high response time.

In general OLED display devices, one unit pixel is configured with a red (R), green (G), and blue (B) sub-pixels, and an image of various colors is displayed through the three sub-pixels.

If the OLED display device displays a fixed image (for example, broadcaster's logo) for a long time, light emitting elements corresponding thereto also continuously emit light. If a current continuously flows through a specific light-emitting element for a long time, the corresponding light-emitting element is overloaded, thus decreasing the lifespan of the corresponding light-emitting element. Therefore, color expressiveness of the corresponding light-emitting element is degraded. Also, if images are changed on a screen, a residual image of a previous image remains or a burn-in phenomenon, in which a screen is not vividly displayed as a stained screen, occurs.

SUMMARY

Embodiments provide an OLED display device and a method of operating the same, which distribute a load to sub-pixels other than a specific sub-pixel such that the specific sub-pixel is not overloaded by using a WRGB-based OLED pixel structure, preventing a residual image and degradation of the specific sub-pixel, which may occur in the OLED display device.

Embodiments provide an OLED display device and a method of operating the same, which prevent a residual image and degradation of a specific sub-pixel, which may occur in the OLED display device, without a change in the color itself of a pixel, by using a WRGB-based OLED pixel structure.

Embodiments provide an OLED display device and a method of operating the same, which distribute a load to sub-pixels other than a specific sub-pixel such that the specific sub-pixel is not overloaded and, at the same time, apply a time difference with respect to adjustment of data values of overloaded pixels, by using a WRGB-based OLED pixel structure, preventing a flicker.

In one embodiment, an organic light emitting diode (OLED) display device includes: a display panel configured to display an image inputted from an outside and the display panel includes a plurality of pixels each having a red sub-pixel, a green sub-pixel, a blue sub-pixel, and a white sub-pixel; and a controller configured to obtain a second red data value, a second green data value, a second blue data value, and a white data value based on a first red data value, a first green data value, and a first blue data value of the image inputted from the outside, and apply the second red data value to the red sub-pixel, the second green data value to the green sub-pixel, the second blue data value to the blue sub-pixel, and the white data value to the white sub-pixel, wherein the controller adjusts the white data value if a same data value is applied to at least one of the red, green, blue, and white sub-pixels for a predetermined time.

The controller may adjust the second red data value, the second green data value, and the second blue data value, based on the adjusted white data value.

The controller may adjust the second red data value, the green data green, and the second blue data value by a value corresponding to the adjusted white data value.

If the white data value is returned to its original white data value within a predetermined period of time after the white data value is adjusted, the controller may apply the original white data value to the white sub-pixel.

If any one of the second red data value, the second green data value, and the second blue data value is 0, the controller may decrease data values of other sub-pixels that are not 0 by a predetermined ratio.

If the second red data value, the second green data value, and the second blue data value are not 0, the controller may adjust the white data value.

The controller may adjust the white data value in a specific range based on a data value of a sub-pixel of which a compensation value for compensating for degradation characteristics is the largest, from among the sub-pixels.

The controller may adjust the white data value to a maximum in the specific range if the sub-pixel of which the compensation value is the largest is the blue sub-pixel, and adjust the white data value to a minimum in the specific range if the sub-pixel of which the compensation value is the largest is the white sub-pixel.

The controller may adjust the white data value with a time difference with respect to pixels in which the same data value is applied to at least one of red, green, blue, and white sub pixels for a predetermined period of time, in a periodic manner with respect to the pixels, in a case of adjusting the white data value to a maximum or a minimum in a specific range.

If the same data value is applied to a predetermined percentage or more of the plurality of pixels for a predetermined period of time, the controller may adjust the white data value.

In another embodiment, a method of operating an organic light emitting diode (OLED) display device includes: displaying an image inputted from an outside through a display panel including a plurality of pixels, each having a red sub-pixel, a green sub-pixel, a blue sub-pixel, and a white sub-pixel; obtaining a second red data value, a second green data value, a second blue data value, and a white data value based on a first red data value, a first green data value, and a first blue data value of the image inputted from the outside;

applying the second red data value to the red sub-pixel, the second green data value to the green sub-pixel, the second blue data value to the blue sub-pixel, and the white data value to the white sub-pixel; and, if a same data value is applied to at least one of the red, green, blue, and white sub-pixels for a predetermined period of time, adjusting the white data value.

DETAILED DESCRIPTION OF THE EMBODIMENTS

Hereinafter, exemplary embodiments will be described in detail with reference to the accompanying drawings. A suffix "module" or "unit" used for constituent elements disclosed in the following description is merely intended for easy description of the specification, and the suffix itself does not give any special meaning or function.

Figure 1:
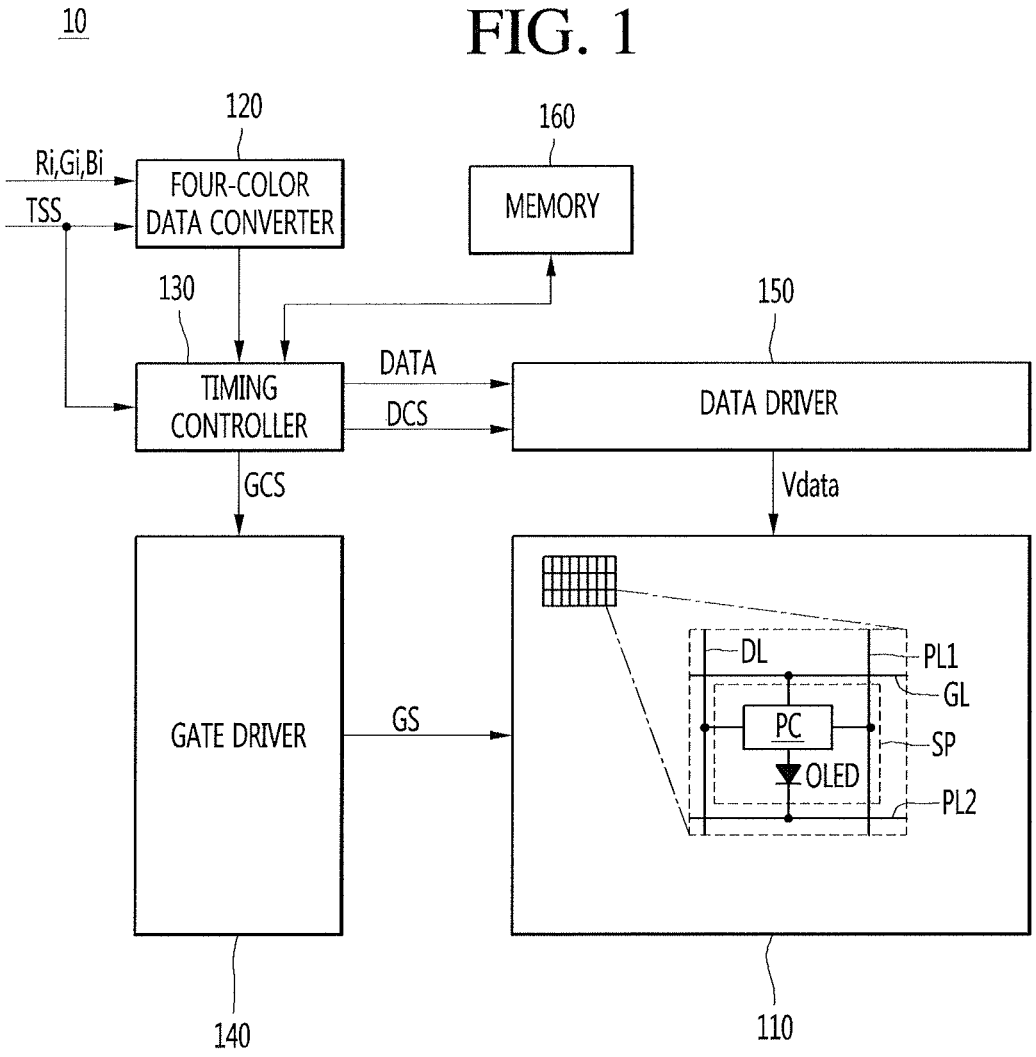
FIG. 1 is a diagram for describing a configuration of an OLED display device according to an embodiment.

FIG. 1 is a diagram for describing a configuration of an OLED display device 10 according to an embodiment.

Referring to FIG. 1, the OLED display device 10 according to the present embodiment may include a display panel 110, a four-color data converter 120, a timing controller 130, a gate driver 140, a data driver 150, and a memory 160.

The display panel 110 may include a plurality of sub-pixels SP. The plurality of sub-pixels SP may be respectively formed in a plurality of pixel areas defined by intersections between a plurality of gate lines GL and a plurality of data lines DL. A plurality of driving power lines PL for supplying a driving voltage are formed respectively in parallel to the plurality of data lines DL in the display panel 110.

Each of the plurality of sub-pixels SP may be any one of red, green, blue, and white sub-pixels. One unit pixel displaying one image may include adjacent red, green, blue, and white sub-pixels, or include red, green, and blue sub-pixels. Hereinafter, one unit pixel is assumed as including red, green, blue, and white sub-pixels.

Each of the plurality of sub-pixels SP may include an organic light emitting element OLED and a pixel circuit PC. The organic light emitting element OLED is connected between the pixel circuit PC and a corresponding second driving power line PL2, and emits light in proportion to an amount of a data current supplied from the pixel circuit PC to emit light of a certain color. To this end, the organic light emitting element OLED includes an anode electrode (pixel electrode) connected to the pixel circuit PC, a cathode electrode (reflective electrode) connected to the second driving power line PL2, and an emission cell that is formed between the anode electrode and the cathode electrode to emit light of any one of red, green, blue, and white. Here, the emission cell may be formed to have a structure of a hole transport layer/organic emission layer/electron transport layer or a structure of a hole injection layer/hole transport layer/organic emission layer/electron transport layer/electron injection layer. Further, the emission cell may further include a function layer for enhancing light-emission efficiency and/or lifespan of the organic emission layer.

The pixel circuit PC supplies a data current corresponding to a data voltage Vdata, supplied from the data driver 150 to a corresponding data line DL, to the organic light emitting element OLED in response to a gate signal GS having a gate-on voltage level, which is supplied from the gate driver 140 to a corresponding gate line GL. In this case, the data voltage Vdata has a voltage value in which degradation characteristics of the organic light emitting element OLED is compensated. To this end, the pixel circuit (PC) may include a switching transistor, a driving transistor, and at least one capacitor, which are formed on a substrate by a process for forming a thin film transistor (TFT). Examples of the switching transistor and the driving transistor may include an a-Si TFT, a poly-Si TFT, an oxide TFT, and an organic TFT.

The switching transistor may supply the data voltage Vdata, supplied to the data line DL, to a gate electrode of the driving transistor according to the gate signal having the gate-on voltage level, which is supplied to the gate line GL.

The driving transistor may be turned on according to a gate-source voltage including the data voltage Vdata supplied from the switching transistor to control an amount of a current flowing into the organic light emitting element OLED from the driving voltage line PL1.

The four-color data converter 120 may generate data to be supplied to unit pixels of the display panel 110, based on three-color input data Ri, Gi and Bi of red, green, and blue, and a timing synchronization signal (TSS) input from an external system body (not illustrated) or a graphics card (not illustrated). The four-color data converter 120 may generate four-color data R, G, B and W of red, green, blue, and white to be respectively supplied to red, green, blue, and white sub-pixels constituting a unit pixel, based on the timing synchronization signal TSS and the three-color input data Ri, Gi, and Bi. The generated four-color data R, G, B and W may be provided to the timing controller 130.

The four-color converter 120 may further include a filter (not illustrated). The filter can remove the noise of the three-color input data. For example, the filter may perform filtering with respect to respective grayscale levels of red data, green data, and blue data, removing the noise of the three-color input data. The filter may filter one or more of the red data, the green data, and the blue data.

The four-color data converter 120 may be included in the timing controller 130.

The timing controller 130 may respectively control driving timings of the gate driver 140 and the data driver 150 based on the timing synchronization signal TSS input from the external system body (not illustrated) and the graphics card (not illustrated). The timing controller 130 may generate a gate control signal GCS and a data control signal DCS based on the timing synchronization signal TSS, such as a vertical synchronization signal, a horizontal synchronization signal, a data enable signal, or a dot clock. The timing controller 130 may control the driving timing of the gate driver 140 through the gate control signal GCS, and control the driving timing of the data driver 150 through the data control signal DCS so as to be synchronized with the driving timing of the gate driver 140.

The timing controller 130 may accumulate and store, in the memory 160, the data R, G, B and W of sub-pixels SP, supplied from the four-color data converter 120 in the unit of sub-pixels SP, per each frame or an accumulation period set to a predetermined period.

The gate driver 140 may generate a gate signal GS corresponding to a display order of an image and supply the gate signal GS to a corresponding gate line GL, based on the gate control signal GCS provided by the timing controller 130. The gate driver 140 may be formed of a plurality of integrated circuits (IC), or may be directly formed on the display panel 110 during a process for forming a transistor for each sub-pixel (SP), and may be connected to one side or both sides in each of the plurality of gate lines (GL).

The data driver 150 may be provided with pixel data DATA and the data control signal DCS by the timing controller 130. The data driver 150 may be provided with a plurality of reference gamma voltages by an external reference gamma voltage supplying unit (not illustrated). The data driver 150 may convert the pixel data DATA into a data voltage Vdata of analog type based on the data control signal DCS and the plurality of reference gamma voltages. The data driver 150 may supply the data voltage Vdata to a data line DL of a corresponding sub-pixel SP. Therefore, in each of the unit pixels constituting the display panel 110, a corresponding organic light emitting element OLED emits light by a data current based on the data voltage Vdata supplied to each sub-pixel SP, displaying a certain image. In this case, in each unit pixel, three sub-pixels including a white sub-pixel from among red, green, blue, and white sub-pixels may be driven or all the four sub-pixels may be driven. The data driver 150 may be formed of a plurality of integrated circuits (IC) and may be connected to one side or both sides of the data line DL.

The timing controller 130 may control operations of the four-color converter 120, the gate driver 140, the data driver 150, and the memory 160.

Since the OLED display device 10 illustrated in FIG. 1 is merely an embodiment, some of illustrated elements may be combined, added, or omitted according to a specification of the OLED display device 10 which is actually implemented. For example, the four-color data converter 120 and the timing controller 130 may be configured by one controller or the four-color data converter 120, the timing controller 130, the gate driver 140, and the data driver 150 may be configured by one controller (not illustrated).

That is, if needed, two or more elements may be combined into one element, or one element may be separated into two or more elements. Also, a function performed in each block is for describing embodiments of the present disclosure, and a specific operation or device therefor do not limit the scope of the prevent disclosure.

Next, a method of operating the OLED display device according to an embodiment will be described with reference to FIG. 2.

Also, the following description will be given in connection with the configuration of the OLED display device, which has been described with reference to FIG. 1.

Figure 2:
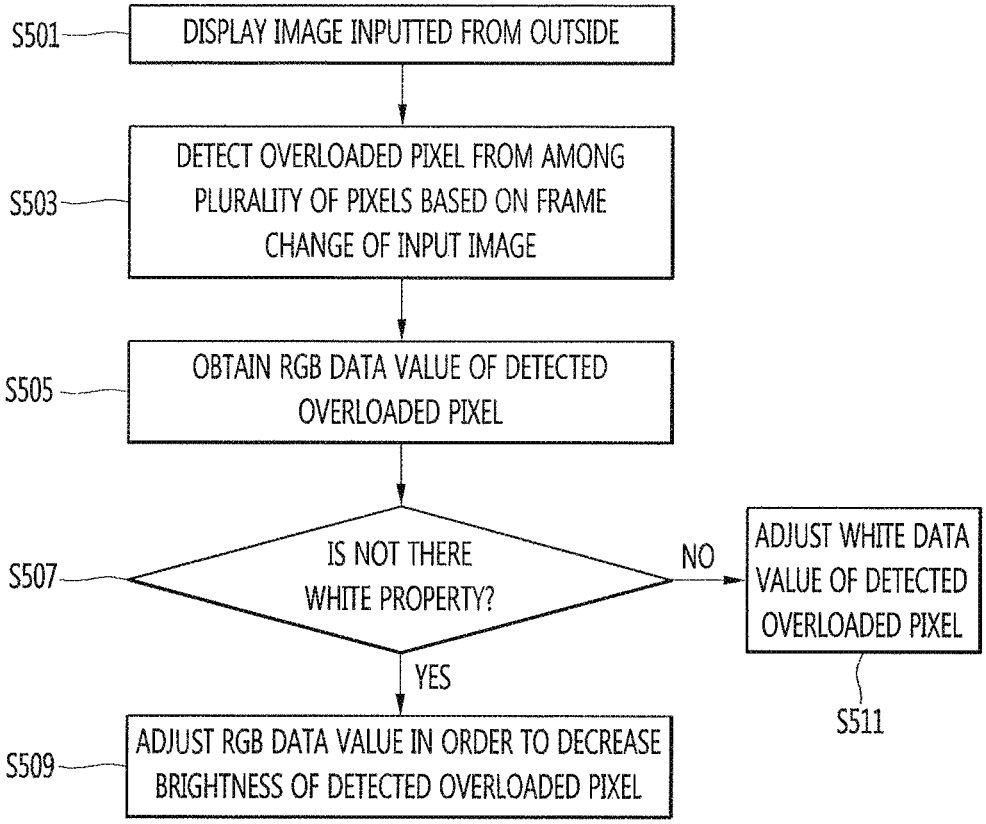
FIG. 2 is a flowchart of a method of operating an OLED display device according to an embodiment.

FIG. 2 is a flowchart of a method of operating an OLED display device according to an embodiment.

The display panel 110 of the OLED display device 10 displays an image inputted from the outside (S501). According to an embodiment, the display panel 110 may be an organic light emitting display panel.

The timing controller 130 of the OLED display device detects an overloaded pixel of a plurality of pixels constituting the display panel 110 based on frame change of the input image (S503). Each of the plurality of pixels may be the unit pixel described with reference to FIG. 1. The overloaded pixel may be a pixel which becomes the cause of burn-in phenomenon later. The overloaded pixel may be a target pixel, of which a pixel value is to be adjusted.

According to an embodiment, the timing controller 130 may convert RGB data value of the image into WRGB data value, prior to detection of the overloaded pixel. That is, the timing controller 130 may detect the overloaded pixel after having converted the RGB data value of the image into the WRGB data value.

Specifically, the timing controller 130 may obtain a second red data value, a second green data value, a second blue data value, and a white data value based on a first red data value, a first green data value, and a first blue data value of the image input from the outside. The timing controller 130 may apply the obtained second red data value to a red sub-pixel, apply the obtained second green data value to a green sub-pixel, apply the obtained second blue data value to a blue sub-pixel, and apply the obtained white data value to a white sub-pixel.

According to the an embodiment, the timing controller 130 may adjust the white data value if the data value applied to at least one of the red, green, blue, and white sub-pixels is same for a predetermined period of time. In this case, the predetermined period of time may be three seconds, which is merely an exemplary value. If the data value applied to at least one of the red, green, blue, and white sub-pixels is same for the predetermined period of time, the timing controller 130 may detect a corresponding pixel as an overloaded pixel and adjust a white data value of the corresponding pixel. However, the present embodiment is not limited thereto. If the data value applied to at least one of the red, green, blue, and white sub-pixels is same for the predetermined period of time, the timing controller 130 may adjust white data values of all pixels constituting the display panel 110.

According to another embodiment, if the same value is applied to at least one pixel for a predetermined period of time, the timing controller 130 may adjust the white data value applied to a white sub-pixel thereof. Specifically, if the data value applied to at least one pixel is same for the predetermined period of time, the timing controller 130 may detect a corresponding pixel as an overloaded pixel and adjust the white data value of the corresponding pixel. However, the present embodiment is not limited thereto. If the data value applied to at least one pixel is same for the predetermined period of time, the timing controller 130 may adjust white data values of all pixels constituting the display panel 110.

According to another embodiment, if the same data value is applied to a predetermined percentage or more of a plurality of pixels for a predetermined period of time, the timing controller 130 may adjust white data values applied to white sub-pixels. The predetermined percentage may be 60% which is merely an exemplary value. The timing controller 130 may adjust the white data values of all pixels constituting the display panel 110 if the data value applied to at least one pixel is same for the predetermined period of time.

A process of adjusting a white data value may be performed according to step S511 described below.

According to another embodiment, if a data value of each of a plurality of pixels constituting the display panel 110 is maintained a predetermined number of times or more times according to frame change of an image input from the outside, the timing controller 130 may determine a corresponding pixel as an overloaded pixel. The data value of each of the plurality of pixels may be a combination of a data value of a red sub-pixel, a data value of a green sub-pixel, and a data value of a blue sub-pixel or a combination of a data value of a red sub-pixel, a data value of a green sub-pixel, a data value of a blue sub-pixel, and a data value of a white sub-pixel. A data value of each sub-pixel may be a grayscale value (or grayscale level).

The timing controller 130 may obtain a pixel value of each of the plurality of pixels constituting a frame and, if the obtained pixel value is maintained a predetermined number of times or more times according to frame change, determine a corresponding pixel as an overloaded pixel. A description will be given below with reference to the accompanying drawings.

Figure 3:
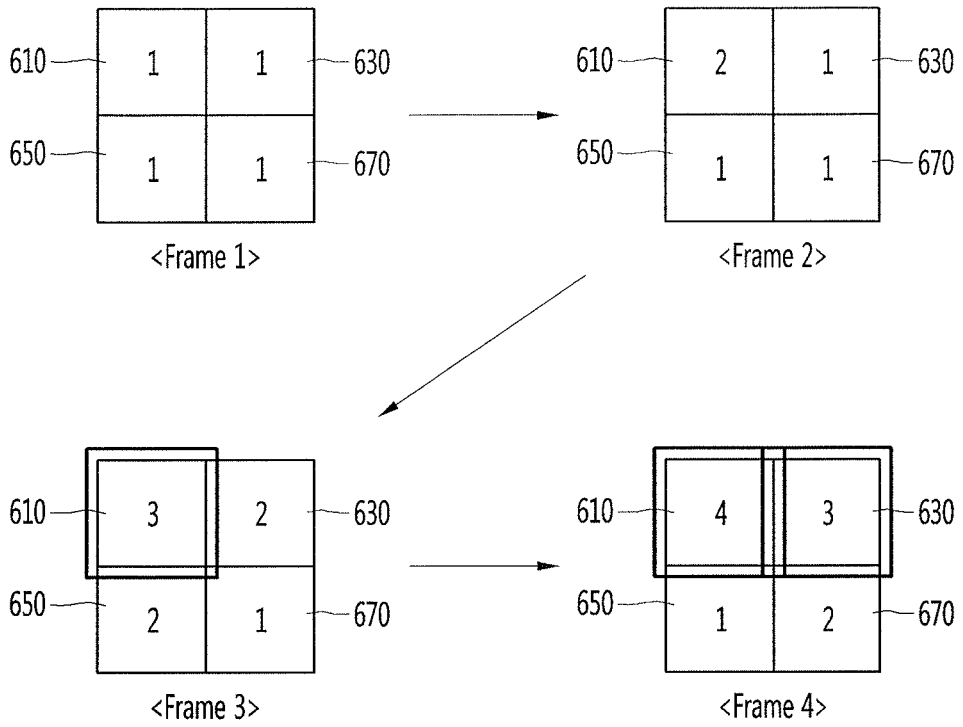
FIG. 3 is a diagram for describing a method of detecting an overloaded pixel based on frame change of images according to an embodiment.

FIG. 3 is a diagram for describing a method of detecting an overloaded pixel based on frame change of an image, according to an embodiment.

Referring to FIG. 3, there are illustrated frames of an image which are changed with the lapse of time. Four frames are illustrated as an example in FIG. 3. The four frames may be consecutive frames with the lapse of time. That is, the four frames may be assigned numbers according to the input orders thereof.

Each of the frames may include a first pixel 610, a second pixel 630, a third pixel 650, and a fourth pixel 670 which are merely illustrative. A data value of each of pixels constituting a frame 1 is a reference value for detection of an overloaded pixel. The number of accumulations of the same data is 1, which is denoted as "1" on each pixel in FIG. 3.

If frame change is made from the frame 1 to a frame 2 (that is, scene change is made), the timing controller 130 may obtain a data value of each pixel and determine whether the obtained data value of each pixel is same. For example, if a frame of an image is changed from the frame 1 to the frame 2, a data value of the first pixel 610 of the frame 2 is identical to the data value of the first pixel 610 of the frame 1. That is, a frame is changed but the data value of a pixel has been maintained. Since the data value of the first pixel 610 is same even if the frame 1 is changed to the frame 2, the same data value may be accumulated. Since the data values of the first pixel 610 in two frames are equal, the number of accumulations of the same data value of the first pixel 610 may be denoted as "2" in FIG. 3. The timing controller 130 may store the number of accumulations of the same data value with respect to each pixel according to frame change.

The data value of the second pixel 630 of the frame 2 is changed, compared to the second pixel 630 of the frame 1. The data values of the third pixel 650 and the fourth pixel 670 are also changed. Therefore, with respect to the frame 2, the number of accumulations of the same data value for each of the second pixel 630, the third pixel 650, and the fourth pixel 670 may be denoted as "1".

If the frame of the image is changed from the frame 2 to the frame 3, the data value of the first pixel 610 of the frame 2 is identical to the data value of the first pixel 610 of the frame 3. That is, the number of accumulations of the same data value is 3, which is denoted as "3" on the first pixel 610 in the frame 3. Since the data value of the first pixel 610 is identically maintained while the frame of the image is changed three times, the first pixel 610 may be detected as an overloaded pixel. That is, if the data value of a specific pixel is accumulated equally three times with respect to consecutive frames of the image with the lapse of time, the timing controller 130 may detect a corresponding pixel as an overloaded pixel. In this case, three times are merely an example.

Since the pixel data values of the second pixel 630 and the pixel data values of the third pixel 650 in the frame 2 and the frame 3 are respectively equal, the timing controller 130 may count the number of accumulations of the same data value as 2 with respect to the second pixel 630 and the third pixel 650.

In this case, since the data value of the fourth pixel 670 of the frame 3 is different from the data value of the fourth pixel 670 of the frame 2, the number of accumulations of the same data value is 1.

If the frame of the image is changed from the frame 3 to the frame 4, the data value of the second pixel 630 is equally accumulated three times, the timing controller 130 may detect the second pixel 630 as an overloaded pixel.

As a result, the timing controller 130 may detect, as an overloaded pixel, the first pixel 610 and the second pixel 630 of which the pixel values are equal a predetermined number of times or more time's according to frame change of the image.

Again, details will be described below with reference to FIG. 2.

The timing controller 130 of the OLED display device 10 may obtain a RGB data value of the detected overloaded pixel (S505). According to an embodiment, the timing controller 130 may respectively obtain a red sub-pixel value (red data value), a green sub-pixel value (green data value), and a blue sub-pixel value (green data value) of the overloaded pixel.

The RGB data value is a value resulting from combining the red data value, the green data value, and the blue data value. The sub-pixel values may be classified into 256 grayscale levels of 0 to 255, which are merely an example, and may have normalized values. If the sub-pixel values are classified into 256 levels, colors which can be expressed by pixels may be 256 colors.

The timing controller 130 of the OLED display device may determine whether there is a white property in the overloaded pixel based on the obtained RGB data value of the overloaded pixel (S507). According to an embodiment, if any one of the red data value, the green data value, and the blue data value of the overloaded pixel is 0, the timing controller 130 may determine that there is no white property in the overloaded pixel. On the contrary, if all of the red data value, the green data value, and the blue data value of the overloaded pixel are not 0, the timing controller 130 may determine that there is a white property in the overloaded pixel.

If there is no white property in the overloaded pixel, the timing controller 130 of the OLED display device 10 may adjust the obtained RGB data value itself of the overloaded pixel (S509). If there is no white property in the overloaded pixel, the timing controller 130 may adjust the RGB data value of the overloaded pixel so as to reduce brightness of the pixel.

According to an embodiment, the timing controller 130 may adjust the RGB data value of the overloaded pixel so as to decrease the RGB data value of the overloaded pixel by predetermined magnitude.

According to another embodiment, the timing controller 130 may adjust the RGB data value of the overloaded pixel to a value corresponding to a black color.

According to still another embodiment, the timing controller 130 may adjust the RGB data value of the overloaded pixel so as to reduce the RGB data value of the overloaded pixel by a predetermined magnitude in a periodic manner. The above configuration will be described with reference to the drawings.

Figure 4A:
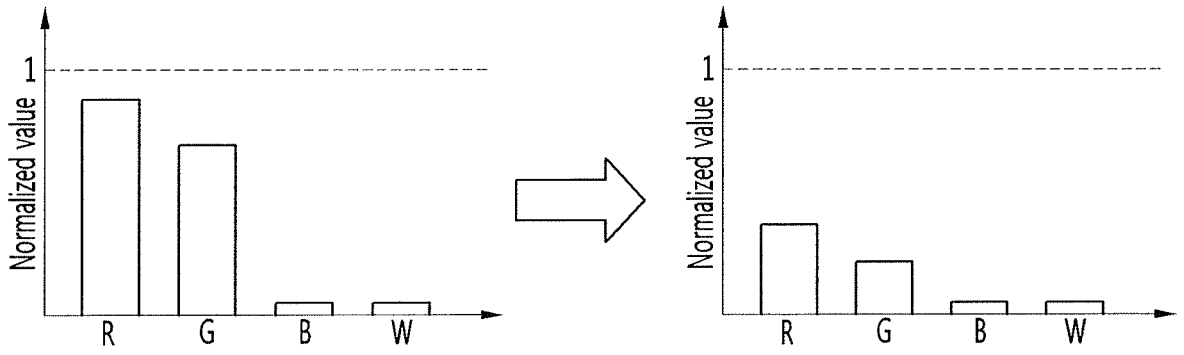
FIGS. 4A to 4C are diagrams for describing an embodiment in which an RGB data value of a detected overloaded pixel is adjusted if there is no white property in the overloaded pixel according to an embodiment.
Figure 4B:
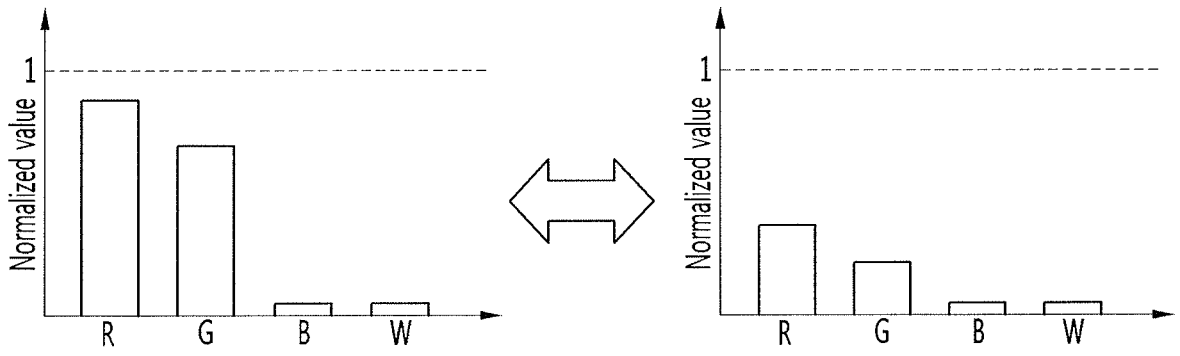
Figure 4C:
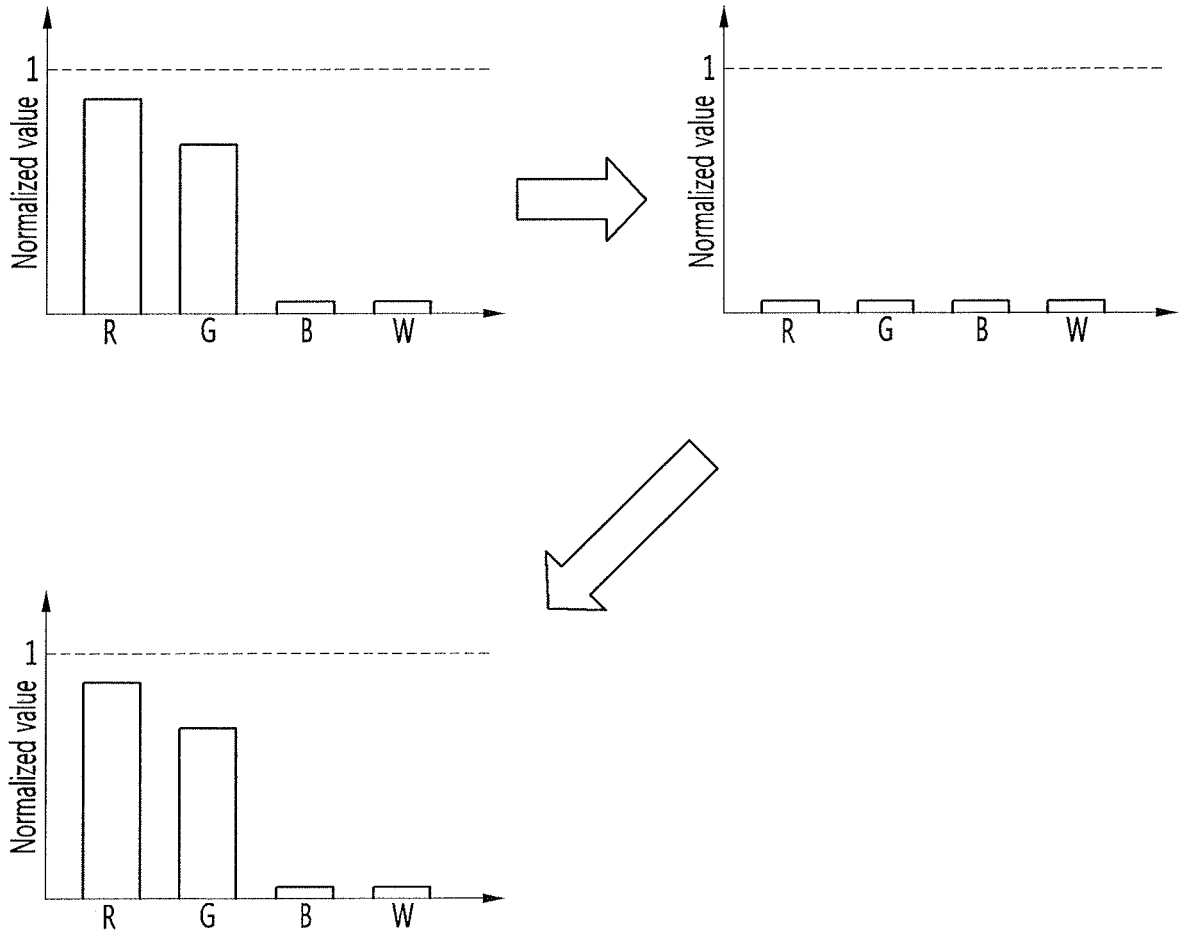

FIGS. 4A to 4C are diagrams for describing an embodiment in which an RGB data value of a detected overloaded pixel is adjusted if there is no white property in the overloaded pixel according to an embodiment.

Referring to FIGS. 4A to 4C, the following description will be given under the assumption that a blue data value is 0 if there is no white property in an overloaded pixel. However, the present disclosure is not limited thereto, and is applicable to a case where a red data value or a green data value, not the blue data value, is 0.

Also, graphs in FIGS. 4A to 4C represent that each sub-pixel value (data value of each color) in the range of 0 to 255 is expressed by a normalized value. That is, 255 may correspond to a normalized value of 1.

Referring to FIG. 4A, it can be seen that a blue data value of the overloaded pixel is 0. This may mean that there is no white property in the overloaded pixel. If there is no white property in the overloaded pixel, the timing controller 130 may decrease the RGB data value of the overloaded pixel. Specifically, if there is no white property in the overloaded pixel, the timing controller 130 may decrease the RGB data value by decreasing the red data value and the green data value by a predetermined ratio. It can be seen from the graph of FIG. 4A that the red data value and the green data value have been decreased by a predetermined ratio. In this case, the predetermined ratio may be 50%, which is merely an exemplary value. The brightness may be also decreased as the RGB data value of the overloaded pixel is decreased. Accordingly, a load of the overloaded pixel can be decreased.

According to an embodiment, if an overload state of the overloaded pixel ends according to frame change of an image, the timing controller 130 may stop the adjustment of the RGB data value as in FIG. 4A. The case where the overload state ends may be a case where the value of the overloaded pixel is maintained identically a predetermined number of times or more times and is then changed.

The embodiment of FIG. 4B is an enlarged version of the embodiment of FIG. 4C. That is, if there is no white property in the overloaded pixel, the timing controller 130 may decrease the RGB data value of the overloaded pixel in a periodic manner. Specifically, the timing controller 130 may decrease the red data value and the green data value by a predetermined ratio as illustrated in FIG. 4B, and then increase the red data value and the green data value so as to have the original values thereof. Then, after a predetermined period of time elapses, the timing controller 130 may again decrease the red data value and the green data value by the predetermined ratio.

Referring to FIG. 4C, if there is no white property in the overloaded pixel, the timing controller 130 may adjust a value of a corresponding pixel to a value corresponding to black data in a periodic manner. This can provide the similar effect as if black data is periodically inserted into the corresponding pixel. Specifically, as illustrated in FIG. 4C, if there is no white property in the overloaded pixel, the timing controller 130 may adjust the red data value and the green data value to 0 in a periodic manner. Therefore, the overloaded pixel may express a black color.

The timing controller 130 may maintain the original value of the overloaded pixel, and if a predetermined period elapses, insert black data. According to an embodiment, the predetermined period may be a period set such that a flicker does not occur. For example, the timing controller 130 may adjust the red sub-pixel value and the green sub-pixel value to 0 at a period of the unit of 60 frames. Accordingly, as illustrated in FIG. 4C, the overloaded pixel has an original value and a value of 0, periodically and alternately.

Again, details will be described below with reference to FIG.

The timing controller 130 of the OLED display device 10 adjusts the obtained white data value of the overloaded pixel if there is a white property in the overloaded pixel (S511).

According to an embodiment, the timing controller 130 may adjust a data value of a white sub-pixel to a value corresponding to the RGB data value of the overloaded pixel. In this case, the RGB data value of the overloaded pixel may be a combination of the second red data value, the second green data value, and the second blue data value, which are described above. The timing controller 130 may adjust a WRGB data value to a value corresponding to the RGB data value of the overloaded pixel. That is, the timing controller 130 may adjust the data value of the white sub-pixel so as to correspond to the RGB data value of the overloaded pixel, in order to express the same color. The timing controller 130 may adjust the second red data value, the second green data value, and the second blue data value according to the adjusted data value of the white sub-pixel. The timing controller 130 may adjust the second red data value, the second green data value, and the second blue data value by a value corresponding to the adjusted white data value.

In order words, the timing controller 130 may adjust the WRGB data value so as to correspond to the RGB data value of the overloaded pixel. The WRGB data value may be a value resulting from combination of a white sub-pixel value (white data value), a red sub-pixel value (red data value), a green sub-pixel value (green data value), and a blue sub-pixel value (blue data value). If there is a white property in the overloaded pixel, the timing controller 130 may adjust the white data value, the red data value, the green data value, and the blue data value to values corresponding to the red data value, the green data value, and the blue data value of the overloaded pixel.

The timing controller 130 may adjust a value of the overloaded pixel in a predetermined data value range for the white sub-pixel.

According to an embodiment, the timing controller 130 may adjust the white data value based on a compensation value of a specific sub-pixel constituting the overloaded pixel.

According to another embodiment, if the compensation value of the specific sub-pixel constituting the overloaded pixel is equal to or greater than a predetermined magnitude, the timing controller 130 may adjust the WRGB data value to a value corresponding to the compensation value of the specific sub-pixel. That is, the timing controller 130 may adjust the WRGB data so as to decrease stress of a sub-pixel having a large compensation value. In this case, the case where the compensation value of the specific sub-pixel is equal to or greater than a predetermined magnitude may represent a case where a voltage value or a current value to be compensated is equal to or greater than a predetermined magnitude, due to degradation of a corresponding sub-pixel.

According to another embodiment, the timing controller 130 may adjust the WRGB data value based on a sub-pixel having the greatest compensation value from among specific sub-pixels constituting the overloaded pixel. The timing controller 130 may adjust the WRGB data value to a value corresponding to the compensation value of the sub-pixel having the greatest compensation value. The compensation value may be a voltage value for compensating for degradation characteristics of a sub-pixel.

A process of adjusting a value of an overloaded pixel to a WRGB data value corresponding to an RGB data value of the overloaded pixel will be described with reference to the drawings.

Figure 5:
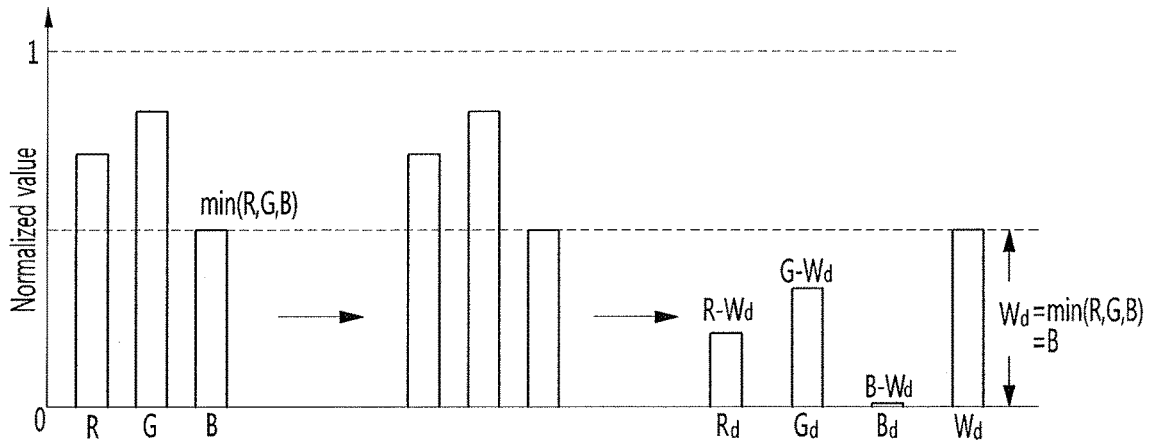
FIG. 5 is a diagram for describing a process by which an OLED display device converts three-color data into four-color data according to an embodiment.
Figure 6:
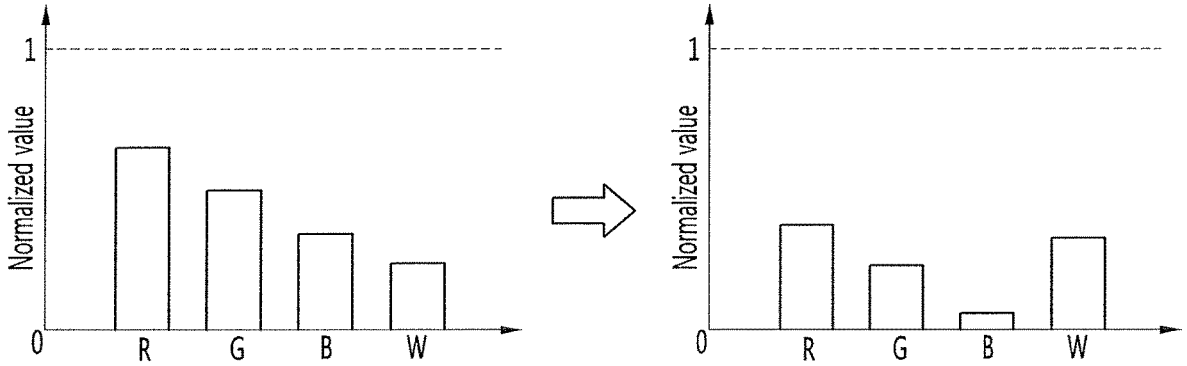
FIGS. 6 and 7 are diagrams for describing examples in which a data value of an overloaded pixel is adjusted to a WRGB data value corresponding to an RGB data value of the overloaded pixel, according to various embodiments.
Figure 7:
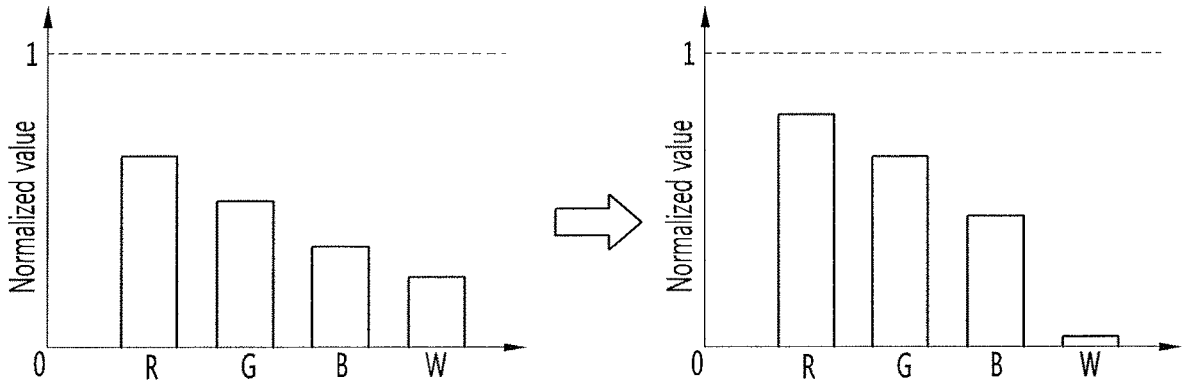

FIG. 5 is a diagram for describing a process by which an OLED display device coverts three-color data into four-color data, according to an embodiment, and FIGS. 6 and 7 are diagrams for describing examples in which a data value of an overloaded pixel is adjusted to a WRGB data value corresponding to an RGB data value of the overloaded pixel according to various embodiments.

First, referring to FIG. 5, there is illustrated a process by which the OLED display device 10 converts three-color input data of red, green, and blue into four-color data of red, green, blue, and white. The timing controller 130 of the OLED display device 10 may obtain the minimum grayscale value (min R, G, B)=B) of the red data value R, the green data value G, and the blue data value B as a white output data value Wd. The timing controller 130 may obtain a red output data value (R−Wd), a green output data value (G−Wd), and a blue output data value (B−Wd) by subtracting the obtained white output data value Wd from the red data value R, the green data value G, and the blue data value B respectively. That is, the OLED display device 10 can convert three-color input data values into four-color output data values.

The embodiments of FIGS. 6 and 7 may correspond to a process performed after the three-color input data values are converted into the four-color output data values through the process of FIG. 5. That is, in FIGS. 6 and 7, the data values of the overloaded pixel may be values resulting from conversion into four-color data.

FIG. 6 illustrates an example in which a white data value of a detected overloaded pixel is adjusted to the maximum, and FIG. 7 illustrates an example in which the white data value of the detected overloaded pixel is adjusted to the minimum. A method of adjusting the white data value of the detected overloaded pixel to the maximum is referred to as a "MAX white rendering method", and a method of adjusting the white data value of the detected overloaded pixel to the minimum is referred to as a "MIN white rendering method".

Also, the following description is given under the assumption that the white data value is adjustable within a specific range. The specific range may be a range of from the minimum 0 to the maximum 50, which is merely an example. The specific range may be a range in which a flicker does not occur, which is also merely an example.

FIG. 6 illustrates the MAX white rendering method performed under the assumption that a compensation value of a blue sub-pixel constituting the detected overloaded pixel is greater than compensation values of other sub-pixels. That is, if the compensation value of the blue data value corresponding to the overloaded pixel is greater than compensation values of other color data values, as illustrated in FIG. 6, the timing controller 130 may increase the white data value to the maximum value in the specific range, in order to reduce stress of the blue sub-pixel. The timing controller 130 may decrease the red data value, the green data value, and the blue data value while increasing the white data value to the maximum in the specific range. A decreased amount of the blue data value may correspond to a decreased amount of the red data value, a decreased amount of the green data value, and an increased amount of the white data value. As a result, the timing controller 130 distributes an overload on the blue sub-pixel to other sub-pixels, thus preventing degradation of the blue sub-pixel and solving the occurrence of a residual image and the shortening of the lifespan thereof.

FIG. 7 is a diagram for describing the MIN white rendering method performed under the assumption that a compensation value of a white sub-pixel constituting a detected overloaded pixel is greater than compensation values for other sub-pixels.

If the compensation value of the white data value corresponding to the overloaded pixel is greater than the compensation values of other color data values, as illustrated in FIG. 7, the timing controller 130 may decrease the white data value to the minimum in the specific range, in order to reduce stress of the white sub-pixel. The timing controller 130 can decrease the white data value to the minimum in the specific range and, at the same time, increase the red data value, the green data value, and the blue data value. The decreased amount of the white data value may correspond to an increased amount of the red data value, an increased amount of the green data value, and an increased amount of the blue data value. As described above, the timing controller 130 may distribute an overload on the white sub-pixel to other sub-pixels, thus preventing degradation of the white sub-pixel.

According to the present embodiment, the timing controller 130 detects the overloaded pixel, adjusts the data value of the white sub-pixel constituting the detected overloaded pixel, and adjusts the data value of the red sub-pixel, the data value of the green sub-pixel, and the data value of the blue sub-pixel by a value corresponding to the adjusted data value of the white sub-pixel.

A user can check whether the data value of the white sub-pixel of the overloaded pixel is adjusted, by measuring brightness of a frame or brightness of a pixel constituting a frame through brightness measuring means, such as a brightness camera. Specifically, in a case where, if a still image is input, the data value of the white sub-pixel is not adjusted to a value corresponding to an RGB data value, the same brightness value will be measured with respect to a frame, an overloaded pixel, or each of sub-pixels constituting the overloaded pixel. In a case where, if a still image is input, the data value of the white sub-pixel is adjusted, and the data value of the red sub-pixel, the data value of the green sub-pixel, and the data value of the blue sub-pixel are adjusted to a value corresponding to the adjusted data value, according to the present embodiment, different brightness values will be measured with respect to the frame, the overloaded pixel, or each of sub-pixels constituting the overloaded pixel.

Also, according to the present embodiment, since it is possible to measure the data values of the sub-pixels constituting the overloaded pixel if a still image is input, the user can check that the data value of the red sub-pixel, the data value of the green sub-pixel, and the data value of the blue sub-pixel have been adjusted by a value corresponding to the adjusted data value of the white sub-pixel. According to another embodiment, if a data value of a pixel detected as an overloaded pixel is changed according to frame change and is then returned to its original value, a compensation operation may be again performed.

Figure 8:
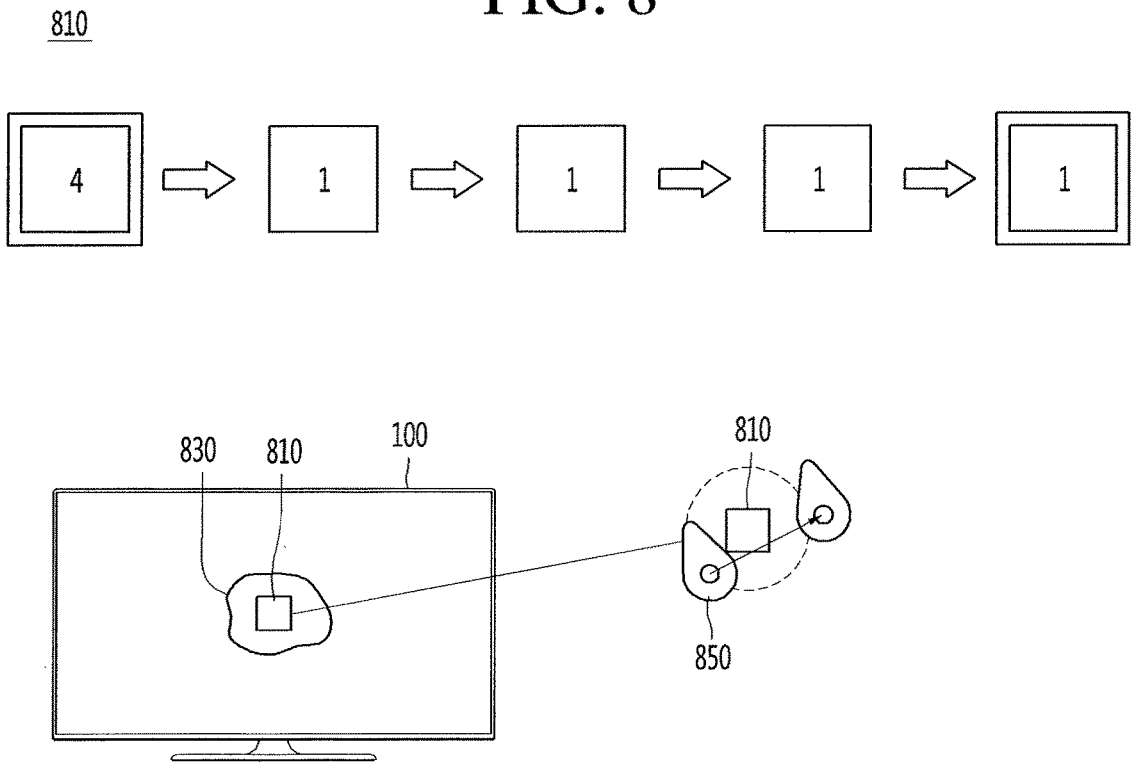
FIG. 8 is a diagram for describing an example in which, if a data value of a pixel detected as an overloaded pixel is changed according to frame change and is then returned to its original value, a compensation operation is again performed, according to an embodiment.

FIG. 8 is a diagram for describing an example in which, if a data value of a pixel detected as an overloaded pixel is changed according to frame change and is then returned to its original value, a compensation operation is again performed, according to an embodiment.

In FIG. 8, it is assumed that an overloaded pixel 810 is in a state in which a compensation operation as in step S511 of FIG. 2 is being performed. Number "4" expressed on the overloaded pixel 810 may represent that the data values of the pixel 810 in four frames are equal. In this state, the data value of the overloaded pixel 810 may be changed according to image change. That is, as illustrated in FIG. 8, the data value of the overloaded pixel 810 may be changed to different values three times according to image change. Thereafter, if the data value of the overloaded pixel 810 is returned to it's original value, the timing controller 130 may adjust the data value of the overloaded pixel 810 to a WRGB value corresponding to an RGB data value. According to an embodiment, if the data value of the overloaded pixel 810 is changed for a predetermined period of time or is changed a predetermined number of times or less times, which corresponds to the number of frames, or less, and is then returned to its original value, the timing controller 130 may again perform an existing compensation operation.

If a still image 830 is displayed on the display panel 110 as illustrated in FIG. 8, there may be a case where a pointer 850 is superimposed on the still image 830 and is moved. That is, although the overloaded pixel 810 is detected due to the still image 830, the data value of the overloaded pixel 810 may be changed due to movement of the pointer 850. Since the still image 830 is continued after the pointer 850 has passed through the overloaded pixel 810, the pixel 810 detected as an overloaded pixel is again overloaded. If the data value of the overloaded pixel 810 is changed for a predetermined period of time or is changed a predefined number of times or less times, which corresponds to the number of frames, and is then returned to its original value, the compensation operation may be again performed. Accordingly, although a specific pixel is overloaded due to the display of a still image in the OLED display device 10, it is possible to reduce the number of executions of a process of repeatedly detecting a corresponding pixel as an overloaded pixel, which may be caused by a temporary event, such as movement of a pointer.

According to another embodiment, the OLED display device 10 may make timings for adjusting a WRGB data value of the overloaded pixel different from one another in order to prevent a flicker.

Figure 9:
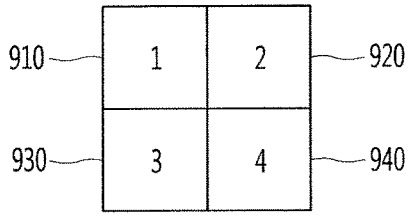
FIGS. 9 to 11 are diagrams for describing examples of making timings for adjusting a WRGB data value of an overloaded pixel different from one another, in order to prevent a flicker, according to an embodiment.
Figure 9:
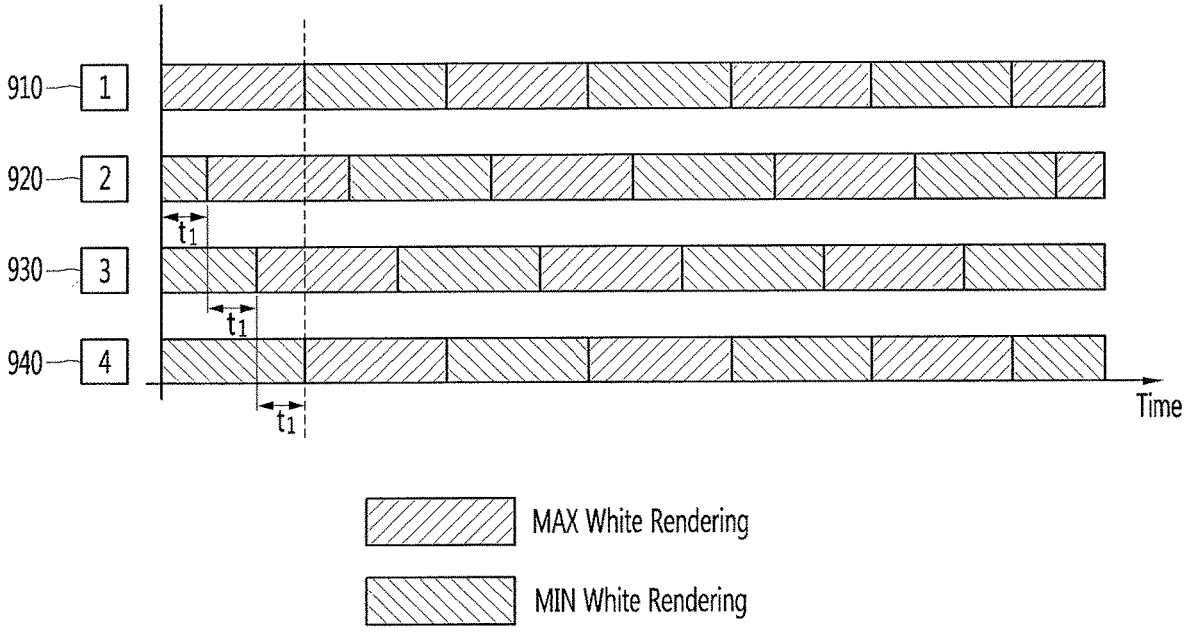
Figure 10:
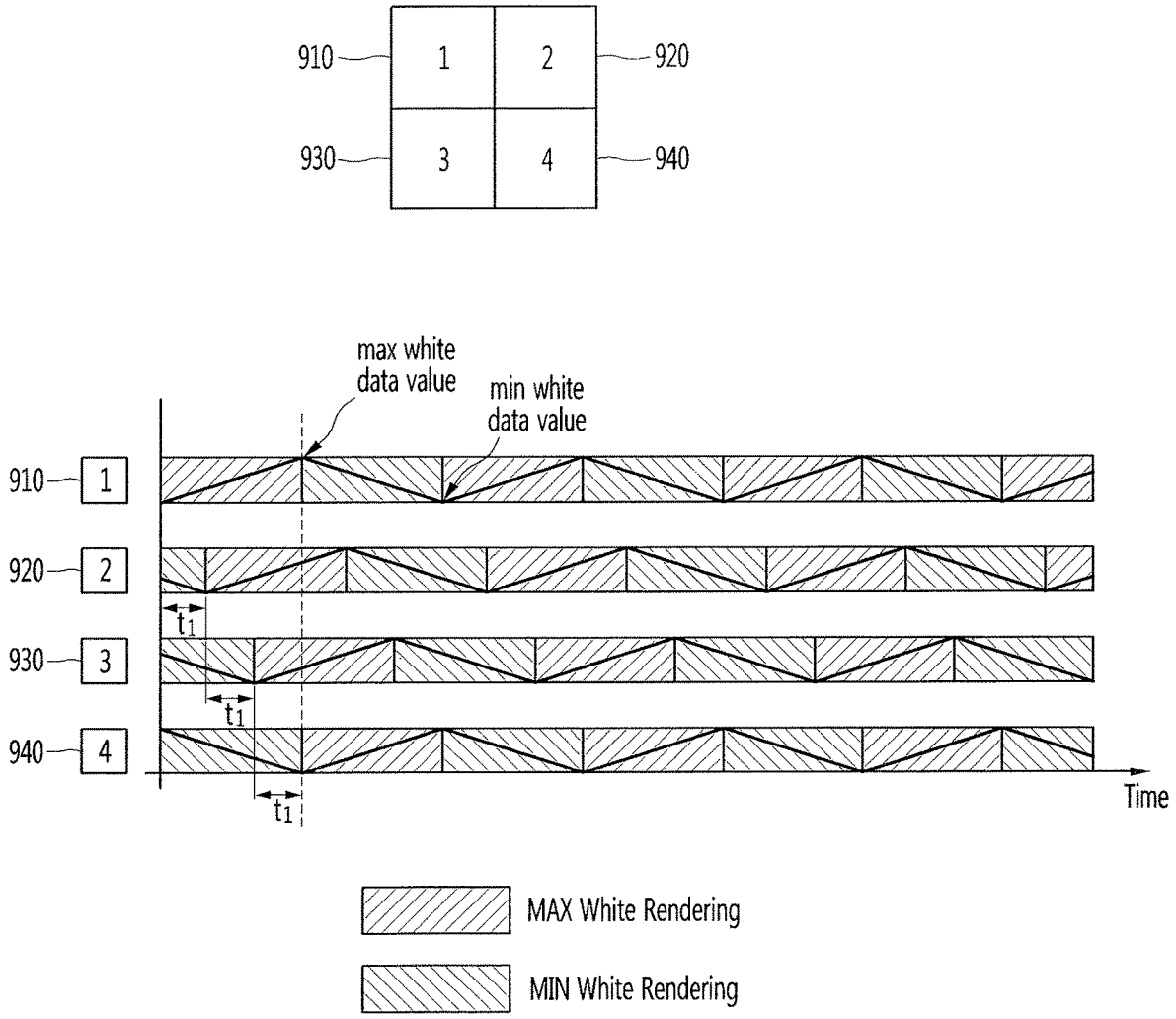
Figure 11:
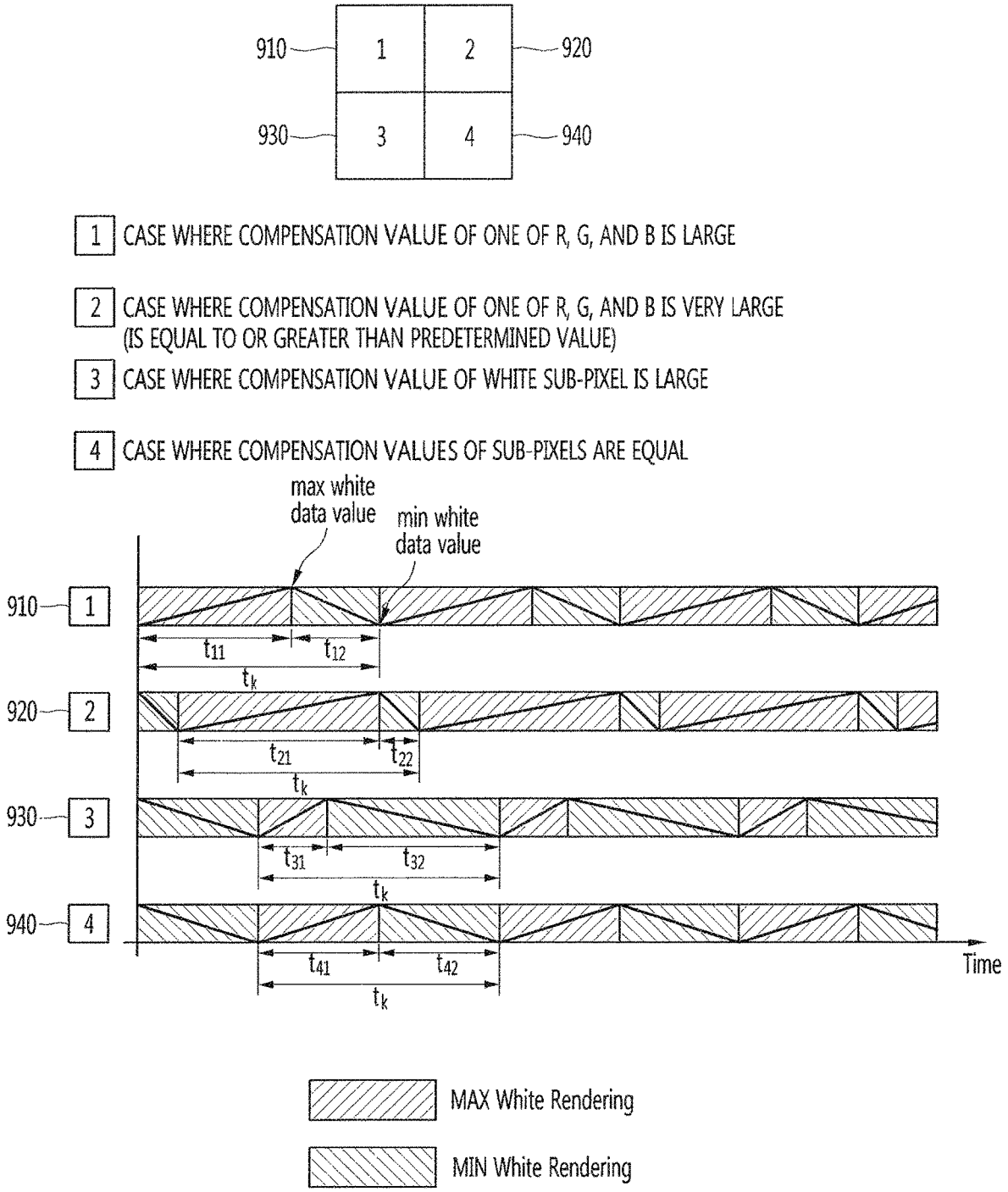

FIGS. 9 to 11 are diagram for describing examples of making timings for adjusting WRGB data values of overloaded pixels different from one another, in order to prevent a flicker according to an embodiment.

If the data value of the overloaded pixel is suddenly changed, a flicker phenomenon where the display panel 110 is flickered may be generated. Therefore, the timing controller 130 may make timings at which the data value of the overloaded pixel is adjusted different from each other.

The following description will be given under the assumption that four pixels 910 to 940 are overloaded pixels in FIG. 9, and the MAX white rendering method described with reference to FIG. 6 and the MIN white rendering method descried with reference to FIG. 7 are repeatedly performed on each of the overloaded pixels.

The timing controller 130 may make timings for adjustment of data values of pixels different from one another in the unit of four pixels. The timing controller 130 applies a time difference with respect to the four overloaded pixels 910 to 940, preventing the same rendering from being performed on the four overloaded pixels at the same timing. Referring to FIG. 9, the timing controller 130 may adjust a data value of the first overloaded pixel 910 by applying the MAX white rendering method to the first overloaded pixel 910. After a period of time t1 elapses, the timing controller 130 may adjust a data value of the second overloaded pixel 920 by applying the MAX white rendering method to the second overloaded pixel 920. That is, before the period of time t1 elapses, the MIN white rendering method is applied to the second overloaded pixel 920, and the data value is adjusted.

Similarly, the timing controller 130 may apply the MAX white rendering method to the third overloaded pixel 930 and the fourth overloaded pixel 940 sequentially as the period of time t1 elapses, thus adjusting the data values thereof. While the MAX white rendering method is being performed on the first overloaded pixel 910, the second overloaded pixel 920, and the third overloaded pixel 930, the MIN white rendering method may be performed on the fourth overloaded pixel 940. The reason for this is that a flicker may occur if the same rendering method is performed on all the four pixels.

As described above, the timing controller 130 may make driving timings different from one another in the unit of four pixels. Accordingly, a user cannot recognize the flicker which may occur if the data value of an overloaded pixel is suddenly changed.

Next, details will be described with reference to FIG. 10.

The following description will be given under the assumption, that four pixels 910 to 940 are overloaded pixels in FIG. 10, and the MAX white rendering method described with reference to FIG. 6 and the MIN white rendering method described with reference to FIG. 7 are changed in phases with respect to the overloaded pixels.

The timing controller 130 may adjust data values of white sub-pixels respectively included in the four detected pixels 910 to 940 with a time difference. The timing controller 130 may perform adjustment so as to gradually increase and then decrease a data value of a white sub-pixel in a specific range with a time difference with respect to the overloaded pixels. For example, the timing controller 130 may increase the white data value in the specific range from the minimum to the maximum so as to have a predetermined slope, with respect to the first overloaded pixel 910. The timing controller 130 may gradually increase the white data value in the specific range from the minimum to the maximum with respect to the second overloaded pixel 920, the third overloaded pixel 930, and the fourth overloaded pixel 940 sequentially with a time difference of the predetermined period of time t1. If the white data value in the specific range becomes the maximum with respect to each of the overloaded pixels, the white data value may be gradually decreased to the minimum.

If a variation amount in the data value of each of the overloaded pixel is large, in the unit of frames, the flicker may occur. Therefore, the timing controller 130 gradually adjusts the data value of each of the overloaded pixels with a time difference with respect to the overloaded pixels in order to suppress occurrence of the flicker.

Next, details will be described with reference to FIG. 11.

The following description will be given under the assumption that four pixels 910 to 940 are overloaded pixels in FIG. 11 and the MAX white rendering method described with reference to FIG. 6 and the MIN white rendering method described with reference to FIG. 7 are changed in phases with respect to the overloaded pixels.

The embodiment of FIG. 11 is basically similar to the embodiment of FIG. 10 but differs from the embodiment of FIG. 10 in that an adjustment period of the data value of the white sub-pixel may be changed based on compensation values of sub-pixels included in the overloaded pixel.

In FIG. 11, a rendering method for the first overloaded pixel 910 may be a method applied based on a sub-pixel of which the compensation value is the largest, from among a red sub-pixel, a green sub-pixel, and a blue sub-pixel.

A rendering method for the second overloaded pixel 920 is a method applied if a compensation value of any one of a red sub-pixel, a green sub-pixel, and a blue sub-pixel is equal to or greater than a preset value.

A rendering method for the third overloaded pixel 930 is a method applied if a compensation value of a white sub-pixel is greater than compensation values of other sub-pixels.

A rendering method for the fourth overloaded pixel 940 is a method applied if the compensation values of the sub-pixels are all equal.

The timing controller 130 may gradually increase a white data value in a specific range from the minimum to the maximum during a period of time t11, and then decrease the white data value from the maximum to the minimum during a period of time t12, with respect to the first overloaded pixel 910. In this case, the period of time t11 may be longer than the period of time t12. The period of time t11 during which the data value of the white sub-pixel is increased from the minimum to the maximum may be longer than the period of time t12 during which the data value of the white sub-pixel is decreased from the maximum to the minimum.

The timing controller 130 may gradually increase a white data value in a specific range from the minimum to the maximum during a period of time t21, and then decrease the white data value from the maximum to the minimum during a period of time t22, with respect to the second overloaded pixel 920. In this case, the period of time t21 may be longer than the period of time t22. Also, the period of time t21 may be longer than the period of time t11, and the period of time t22 may be shorter than the period of time t21. The period of time T21 during which the data value of the white sub-pixel is increased from the minimum to the maximum may be longer than the period of time t11, and the period of time T22 during which the data value of the white sub-pixel is decreased from the maximum to the minimum may be shorter than the period of time t11.

The timing controller 130 may gradually increase a white data value in a specific range from the minimum to the maximum during a period of time t31, and then decrease the white data value from the maximum to the minimum during a period of time t22, with respect to the third overloaded pixel 930. In this case, the period of time t31 may be shorter than the period of time t11. Also, the period of time t31 may be shorter than the period of time t32, and the period of time t32 may be longer than the period of time t12. The period of time T31 during which the data value of the white sub-pixel is increased from the minimum to the maximum may be shorter than the period of time t11, and the period of time T32 during which the data value of the white sub-pixel is decreased from the maximum to the minimum may be longer than the period of time t11.

The timing controller 130 may gradually increase a white data value in a specific range from the minimum to the maximum during a period of time t41, and then decrease the white data value from the maximum to the minimum during a period of time t22, with respect to the fourth overloaded pixel 940. In this case, the period of time t41 may be equal to the period of time t41. Also, the period of time t41 may be shorter than the period of time t11, and the period of time t42 may be longer than the period of time t12. That is, the compensation values of the sub-pixels are all equal, the period of time taken to increase the white data value from the minimum to the maximum may be equal to the period of time taken to decrease the white data value from the maximum to the minimum.

As described above, the timing controller 130 may adjust a period during which the white data value is increased from the minimum to the maximum and a period during which the white data value is decreased from the maximum to the minimum according to degrees of compensation values of sub-pixels constituting an overloaded pixel.

If a variation amount in the data value of each overloaded pixel is large, in the unit of frames, the flicker may occur. The timing controller 130 may adjust a period during which the white data value is increased from the minimum to the maximum and a period during which the white data value is decreased from the maximum to the minimum according to degrees of compensation values of sub-pixels in each overloaded pixel, in order to suppress occurrence of the flicker.

Figure 12A:
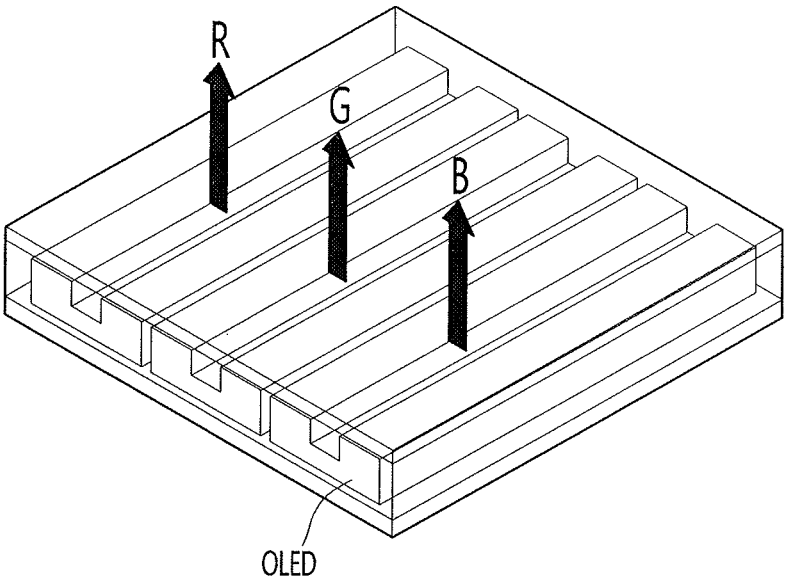
FIG. 12A is a diagram for describing an existing RGB-based OLED structure.
Figure 12B:
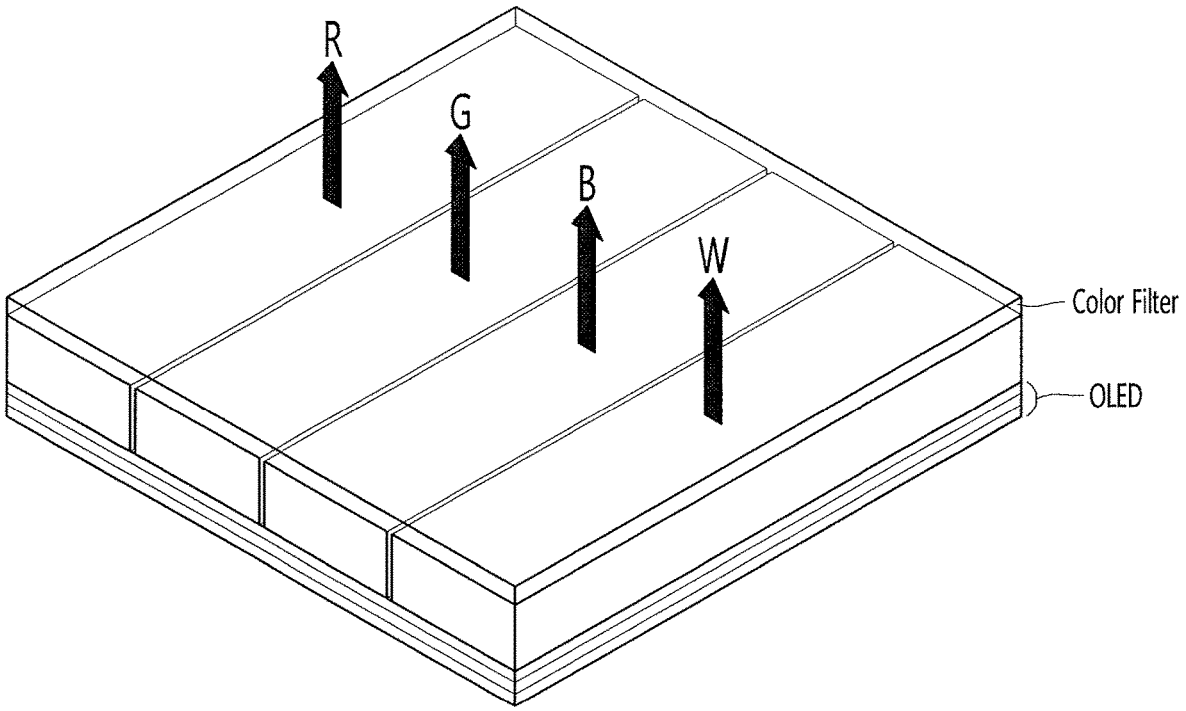
FIG. 12B is a diagram for describing a WRGB-based OLED structure according to an embodiment.

FIG. 12A is a diagram for describing an existing RGB-based OLED structure, and FIG. 12B is a diagram for describing a WRGB-based OLED structure according to an embodiment.

Referring to FIG. 12A, the RGB-based OLED structure may be formed by horizontally depositing RGB organic material for each pixel. Since it is necessary to turn on all red, green, and blue sub-pixels in order to express white in the RGB-based OLED structure, durability of a display panel is not good. Also, efficiency thereof is not good. Therefore, as a large-screen display panel is manufactured, the cost thereof increases.

Referring to FIG. 12B, the WRGB-based OLED structure may be formed by vertically depositing RGB organic material. The WRGB-based OLED structure may be configured in such a way that one unit pixel has white, red, green, and blue sub-pixels. Due to this, the WRGB-based OLED structure enables expression of more intense and brighter colors, compared to the existing RGB-based OLED structure. Furthermore, the WRGB-based OLED structure can provide a wide viewing angle with very little loss in image quality if viewed at any position through a color filter which evenly disperses light emitted by sub-pixels by again filtering the light.

Also, since the WRGB-based OLED structure directly implements a white color, the WRGB-based OLED structure is advantageous than RGB-based OLED structure in terms of power consumption, and the lifespan of the sub-pixels.

The OLED display device 10 described with reference to FIGS. 1 to 11 has the WRGB-based OLED structure in FIG. 12B.

According to the embodiments of the present disclosure, it is possible to adjust a data value of a red sub-pixel, a data value of a green sub-pixel, and a data value of a blue sub-pixel to be dependent on the adjustment of a data value of a white sub-pixel constituting an overloaded pixel, thereby achieving distribution of a load concentrated on a specific pixel, without a change in colors. That is, in the case of the RGB-based method, there is a problem that colors themselves are changed if data values of a red sub-pixel, a green sub-pixel, and a blue sub-pixel are adjusted in order to reduce an overload on a specific sub-pixel. However; according to the WRGB-based method of the present disclosure, if a data value of a red sub-pixel, a data value of a green sub-pixel, and a data value of a blue sub-pixel are adjusted to be dependent on the adjustment on a data value of a white sub-pixel, RGB input data is converted into the same output data, thereby achieving distribution of a load concentrated on a specific sub-pixel and therefore, preventing degradation of the specific sub-pixel.

According to an embodiment, the above-described method may also be embodied as processor readable codes on a program-recorded medium. Examples of the processor readable medium are a ROM, a RAM, a CD-ROM, a magnetic tape, a floppy disk, and an optical data storage device, and the method is also implemented in the form of a carrier wave (such as data transmission through the Internet).

The above-described display device is not limited to the configuration and method of described embodiments, and some or all of the embodiments may also be selectively combined so that various variations may be implemented.

What is claimed is:

1. An organic light emitting diode (OLED) display device, comprising:

a display panel configured to display an image, wherein the display panel includes a plurality of pixels each having a red sub-pixel, a green sub-pixel, a blue sub-pixel, and a white sub-pixel; and a controller configured to:

obtain a second red data value, a second green data value, a second blue data value, and a white data value based on a first red data value, a first green data value, and a first blue data value of the image, apply the second red data value to the red sub-pixel, the second green data value to the green sub-pixel, the second blue data value to the blue sub-pixel, and the white data value to the white sub-pixel, and adjust the white data value if a same data value is applied to at least one of the red, green, blue, and white sub-pixels included in the pixel for a predetermined time, wherein, when the same data value is applied to at least one of the red, green, blue, and white sub-pixels of each pixel included in a unit of four pixels for the predetermined time, the controller is further configured to:

sequentially, increase, after a predetermined period of time, the white data value of a pixel in the unit of four pixels from a minimum white data value to a maximum white data value and reduce the white data value of the pixel in the unit of four pixels from the maximum white data value to the minimum white data value.

2. The OLED display device of claim 1, wherein the controller adjusts the second red data value, the second green data value, and the second blue data value, based on the adjusted white data value.

3. The OLED display device of claim 2, wherein the controller adjusts the second red data value, the second green data value, and the second blue data value by a value corresponding to the adjusted white data value.

4. The OLED display device of claim 1, wherein, if the white data value is returned to its original white data value within a predetermined period of time after the white data value is adjusted, the controller applies the original white data value to the white sub-pixel.

5. The OLED display device of claim 1, wherein, if any one of the second red data value, the second green data value, and the second blue data value is 0, the controller decreases data values of other sub-pixels that are not 0 by a predetermined ratio.

6. The OLED display device of claim 1, wherein, if the second red data value, the second green data value, and the second blue data value are not 0, the controller adjusts the white data value.

7. The OLED display device of claim 1, wherein the controller adjusts the white data value in a specific range based on a data value of a sub-pixel of which a compensation value for compensating for degradation characteristics is the largest, from among the sub-pixels.

8. The OLED display device of claim 7, wherein the controller adjusts the white data value to a maximum in the specific range if the sub-pixel of which the compensation value is the largest is the blue sub-pixel, and adjusts the white data value to a minimum in the specific range if the sub-pixel of which the compensation value is the largest is the white sub-pixel.

9. The OLED display device of claim 1, wherein, if the same data value is applied to a predetermined percentage or more of the plurality of pixels for a predetermined period of time, the controller adjusts the white data value.

10. A method of operating an organic light emitting diode (OLED) display device, comprising:

displaying an image through a display panel including a plurality of pixels, each having a red sub-pixel, a green sub-pixel, a blue sub-pixel, and a white sub-pixel;

obtaining a second red data value, a second green data value, a second blue data value, and a white data value based on a first red data value, a first green data value, and a first blue data value of the image;

applying the second red data value to the red sub-pixel, the second green data value to the green sub-pixel, the second blue data value to the blue sub-pixel, and the white data value to the white sub-pixel; and adjusting the white data value if a same data value is applied to at least one of the red, green, blue, and white sub-pixels included in the pixel for a predetermined time, wherein the adjusting the white data value comprises:

wherein, when the same data value is applied to at least one of the red, green, blue, and white sub-pixels of each pixel included in a unit of four pixels for the predetermined time, sequentially, increasing, after a predetermined period of time, the white data value of a pixel in the unit of four pixels from a minimum white data value to a maximum white data value and reducing the white data value of the pixel in the unit of four pixels from the maximum white data value to the minimum white data value.

11. The method of claim 10, wherein the adjusting of the data value of the white sub-pixel comprises adjusting the second red data value, the second green data value, and the second blue data value based on the adjusted white data value.

12. The method of claim 11, wherein the adjusting of the second red data value, the second green data value, and the second blue data value based on the adjusted white data value comprises adjusting the second red data value, the second green data value, and the second blue data value by a value corresponding to the adjusted white data value.

13. The method of claim 10, wherein the adjusting of the white data value further comprises, if the white data value is then returned to its original white data value within a predetermined period of time after the white data value is adjusted, applying the original white data value to the white sub-pixel.

14. The method of claim 10, wherein the adjusting of the white data value comprises, if any one of the second data value, the second green data value, and the second blue data value is not 0, decreasing data values of other sub-pixels that are not 0 by a predetermined ratio.

15. The method of claim 10, wherein the adjusting of the white data value comprises, if the second red data value, the second green data value, and the second blue data value are not 0, adjusting the white data value.

16. The method of claim 10, wherein the adjusting of the white data value comprises adjusting the white data value in a specific range based on a data value of a sub-pixel of which a compensation value for compensating for degradation characteristics is the largest, from among the sub-pixels.

17. The method of claim 16, wherein the adjusting of the white data value comprises:

adjusting the white data value to a maximum in the specific range if the sub-pixel of which the compensation value is the largest is the blue sub-pixel, and adjusting the white data value to a minimum in the specific range if the sub-pixel of which the compensation value is the largest is the white sub-pixel.

18. The method of claim 10, wherein the adjusting of the white data value comprises, if the same data value is applied to a predetermined percentage or more of the plurality of pixels for a predetermined period of time, adjusting the white data value.

* * * * *